US010935343B2

(12) United States Patent
Chin

(10) Patent No.: US 10,935,343 B2
(45) Date of Patent: Mar. 2, 2021

(54) QUICK-DETACH HANDGUARD LOCKING SYSTEM

(71) Applicant: Strike Industries, Inc., Santa Ana, CA (US)

(72) Inventor: David Chin, Santa Ana, CA (US)

(73) Assignee: Strike Industries, Inc., Santa Ana, CA (US)

( * ) Notice: Subject to any disclaimer, the term of this patent is extended or adjusted under 35 U.S.C. 154(b) by 0 days.

(21) Appl. No.: 16/748,745

(22) Filed: Jan. 21, 2020

(65) Prior Publication Data

US 2020/0232753 A1 Jul. 23, 2020

Related U.S. Application Data

(60) Provisional application No. 62/794,931, filed on Jan. 21, 2019.

(51) Int. Cl.
*F41C 23/16* (2006.01)

(52) U.S. Cl.
CPC ..... *F41C 23/16* (2013.01)

(58) Field of Classification Search
CPC ..... F41C 23/16; F41A 15/18; F41A 15/28
USPC ..... 42/71.01, 75.03, 90, 73
See application file for complete search history.

(56) References Cited

U.S. PATENT DOCUMENTS

| | | | | |
|---|---|---|---|---|
| 4,576,084 | A * | 3/1986 | Brandl | F41A 21/30 181/223 |
| 7,793,452 | B1 * | 9/2010 | Samson | F41C 23/16 42/72 |
| 8,769,853 | B1 * | 7/2014 | Larue | F41C 23/16 42/71.01 |
| 8,931,196 | B1 * | 1/2015 | Larue | F41A 11/04 42/71.01 |
| 10,359,248 | B2 * | 7/2019 | Zinsner | F41A 21/482 |
| 2015/0308779 | A1 * | 10/2015 | McGinty | F41A 21/484 42/75.02 |
| 2020/0173755 | A1 * | 6/2020 | Gonzales | F41G 11/003 |
| 2020/0232753 | A1 * | 7/2020 | Chin | F41A 11/00 |

OTHER PUBLICATIONS

StarDude Outdoors, "Fortis Switch AR15 MOD 2—Best Rail System Available?", Dec. 2, 2018, YouTube, Entire Video, https://www.youtube.com/watch?v=PRtlkIYQV4Q (Year: 2018).*

* cited by examiner

*Primary Examiner* — John Cooper
(74) *Attorney, Agent, or Firm* — Han IP PLLC; Andy M. Han

(57) ABSTRACT

An apparatus implementable on a firearm includes a quick-detach (QD) handguard assembly which includes a handguard and a locking mechanism. The handguard has a hollow therein allowing the handguard to surround a barrel of the firearm with the barrel traversing through the hollow along a longitudinal axis of the handguard. The locking mechanism is coupled to the handguard. The locking mechanism includes a QD lever configured to lock the handguard to a barrel nut of the firearm and unlock the handguard from the barrel nut.

17 Claims, 6 Drawing Sheets

QUICK-DETACH HANDGUARD LOCKING SYSTEM

CROSS REFERENCE TO RELATED PATENT APPLICATION(S)

The present disclosure is part of a non-provisional application claiming the priority benefit of U.S. Provisional Patent Application No. 62/794,931 filed on 21 Jan. 2019, the content of which being incorporated by reference in its entirety.

TECHNICAL FIELD

The present disclosure is generally related to firearms and, more particularly, to a quick-detach (QD) handguard locking system for firearms.

BACKGROUND

Unless otherwise indicated herein, approaches described in this section are not prior art to the claims listed below and are not admitted as prior art by inclusion in this section.

A handguard (also known as forend or forearm) on a firearm refers to a guard attached to the front of the firearm to shield or otherwise protect a user from the barrel of the firearm, which can become very hot when firing. On an AR-style firearm, whether a rifle, carbine or pistol, the handguard is typically secured on a barrel nut of the firearm by either screws or another locking mechanism which requires tools to operate. With the handguard installed, the cycling system of the AR-style firearm (which typically includes a gas block, a gas tube or a piston system) is shielded inside the handguard. When the user needs to maintain, fix or otherwise access the cycling system, the user would need to use tools to disassemble or otherwise remove the handguard. In other situations, the user may also need to use tools to swap an existing handguard for a different one with a different length or configuration (e.g., one with different accessory rail(s) and/or a different accessory mounting system). Such a process tends to be complicated and time consuming.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

In view of the aforementioned issue, an objective of the present disclosure is to provide an innovative design of a QD handguard locking system for firearms. Advantageously, with the quick detach handguard locking system in accordance with the present disclosure, no tool is needed to assemble or otherwise secure a handguard onto a firearm (or the barrel nut thereof) and to disassemble or otherwise remove the handguard from the firearm (or the barrel nut thereof). Thus, assembly and disassembly of the handguard may be performed quickly and with ease (e.g., no tool needed).

In one aspect, an apparatus implementable on a firearm may include a QD handguard assembly which may include a handguard and a locking mechanism coupled to the handguard. The handguard may have a front end, a back end opposite the front end, and a hollow therein allowing the handguard to surround a barrel of the firearm with the barrel traversing through the hollow along a longitudinal axis of the handguard. The handguard may be configured with a slit extending along the longitudinal axis of the handguard between the front end and the back end. The handguard may be also configured with a first opening near the slit and on a first side thereof and a second opening near the slit and on a second side thereof opposite the first side with the first opening and the second opening aligned with each other. The locking mechanism may be configured to lock the handguard to a barrel nut of the firearm and unlock the handguard from the barrel nut. The locking mechanism may include a first tightening nut rotatably received in the first opening of the handguard, a second tightening nut rotatably received in the second opening of the handguard, a fastener, and a QD lever. The fastener may have a first distal end and a second distal end opposite the first distal end. The fastener may be configured with left-hand threads near the first distal end and right-hand threads near the second distal end. The fastener may traverse the handguard latitudinally through the first opening and the second opening such that the first tightening nut is threaded onto the first distal end and the second tightening nut is threaded onto the second distal end. The QD lever may be coupled to a central section of the fastener between the first distal end and the second distal end thereof to be pivotably received in the slit of the handguard to pivot between a releasing position and a locking position such that: (1) when the QD lever is at the releasing position, the QD handguard assembly may be freely movable along the barrel of the firearm, and (2) when the QD lever is at the locking position with the back end of the handguard surrounding the barrel nut, the first tightening nut and the second tightening nut are pulled toward the central section of the fastener to elastically decrease a width of the slit to result in the handguard wrapping and engaging the barrel nut, thereby preventing a movement of the handguard along the barrel of the firearm.

In some implementations, the QD lever may have a base end and an actuation end opposite the base end with the base end coupled to the fastener. An outer contour of the base end may be shaped such that, when the QD lever is at the releasing position, the base end is not engaged with the barrel nut and, when the QD lever is at the locking position, the base end is received in an indentation on the barrel nut to engage with the barrel nut.

In some implementations, the locking mechanism may also include a first detent system and a second detent system. The first detent system may include a first detent, a first detent spring, and a first set screw, and the second detent system may include a second detent, a second detent spring, and a second set screw. In such cases, the handguard may be further configured with a first detent opening traversing a first portion of the handguard through the first opening and a second detent opening traversing a second portion of the handguard through the second opening. Additionally, a circumference of the first tightening nut may be configured with a plurality of first indentations, and a circumference of the second tightening nut may be configured with a plurality of second indentations. Moreover, the first detent system may be disposed in the first detent opening with the first detent protruding into the first opening to physically contact with the circumference with the first tightening nut such that, when the QD lever is pivoted between the releasing position and the locking position, the first detent is pushed by a first force exerted by the first set screw through the first detent spring to enter into and engage with each of the plurality of first indentations. Furthermore, the second detent system may be disposed in the second detent opening with the second detent protruding into the second opening to physically contact with the circumference with the second tightening nut such that, when the QD lever is pivoted between the releasing position and the locking position, the second detent is pushed by a second force exerted by the second set screw through the second detent spring to enter into and engage with each of the plurality of second indentations.

In some implementations, each of the plurality of first indentations and the plurality of second indentations may be shaped such that the QD lever is pivotable from the releasing position to the locking position but not from the locking position to the releasing position unless the first set screw and the second set screw are loosened to remove the first force exerted on the first detent by the first set screw through the first detent spring and the second force exerted on the second detent by the second set screw through the second detent spring.

In some implementations, the handguard may also have a physical feature configured to lock the QD lever in the locking position. In some implementations, the physical feature may include a first slot on the first side and a second slot on the second side thereof. In such cases, the QD lever may have a base end and an actuation end opposite the base end with the base end coupled to the fastener. Additionally, the QD lever may also have a cavity at a tip of the actuation end and a through hole traversing a portion of the cavity. In such cases, the locking mechanism may further include a spring-loaded QD lever locking button assembly received in the cavity at the tip of the actuation end of the QD lever. The QD lever locking button assembly may include at least a QD lever locking button, a button pin protruding from the QD lever locking button, a spring, and a locking bar traversing through the through hole and the button pin. When the QD lever is in the locking position without the QD lever locking button being depressed, two opposite ends of the locking bar may be received at a first end of each of the first slot and the second slot on the handguard such that the QD lever is prevented from being pivoted out of the locking position. When the QD lever is in the locking position with the QD lever locking button being depressed, the two opposite ends of the locking bar may be received at a second end of each of the first slot and the second slot on the handguard such that the QD lever is pivotable from the locking position to the releasing position.

In some implementations, the apparatus may further include the barrel nut with an outer surface of the barrel nut configured with an indentation. In such cases, the QD lever may have a base end and an actuation end opposite the base end with the base end coupled to the fastener. An outer contour of the base end may be shaped such that: (1) when the QD lever is at the releasing position, the base end is not engaged with the barrel nut, and (2) when the QD lever is at the locking position, the base end is received in the indentation on the barrel nut to engage with the barrel nut.

In another aspect, an apparatus implementable on a firearm may include a QD handguard assembly which may include a handguard and a locking mechanism coupled to the handguard. The handguard may have a hollow therein allowing the handguard to surround a barrel of the firearm with the barrel traversing through the hollow along a longitudinal axis of the handguard. The locking mechanism may include a QD lever configured to lock the handguard to a barrel nut of the firearm and unlock the handguard from the barrel nut.

In still another aspect, an apparatus implementable on a firearm may include a QD handguard assembly which may include a handguard and a locking mechanism coupled to the handguard. The handguard may have a front end, a back end opposite the front end, and a hollow therein allowing the handguard to surround a barrel of the firearm with the barrel traversing through the hollow along a longitudinal axis of the handguard. The handguard may be configured with a slit extending along the longitudinal axis of the handguard between the front end and the back end. The locking mechanism may include a QD lever configured to lock the handguard to a barrel nut of the firearm and unlock the handguard from the barrel nut. The QD lever may be pivotably received in the slit of the handguard to pivot between a releasing position and a locking position. The handguard may have a physical feature configured to lock the QD lever in the locking position.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, explain the principles of the disclosure. It is appreciable that the drawings are not necessarily in scale as some components may be shown to be out of proportion than the size in actual implementation to clearly illustrate the concept of the present disclosure.

DETAILED DESCRIPTION OF PREFERRED IMPLEMENTATIONS

Figure 1:
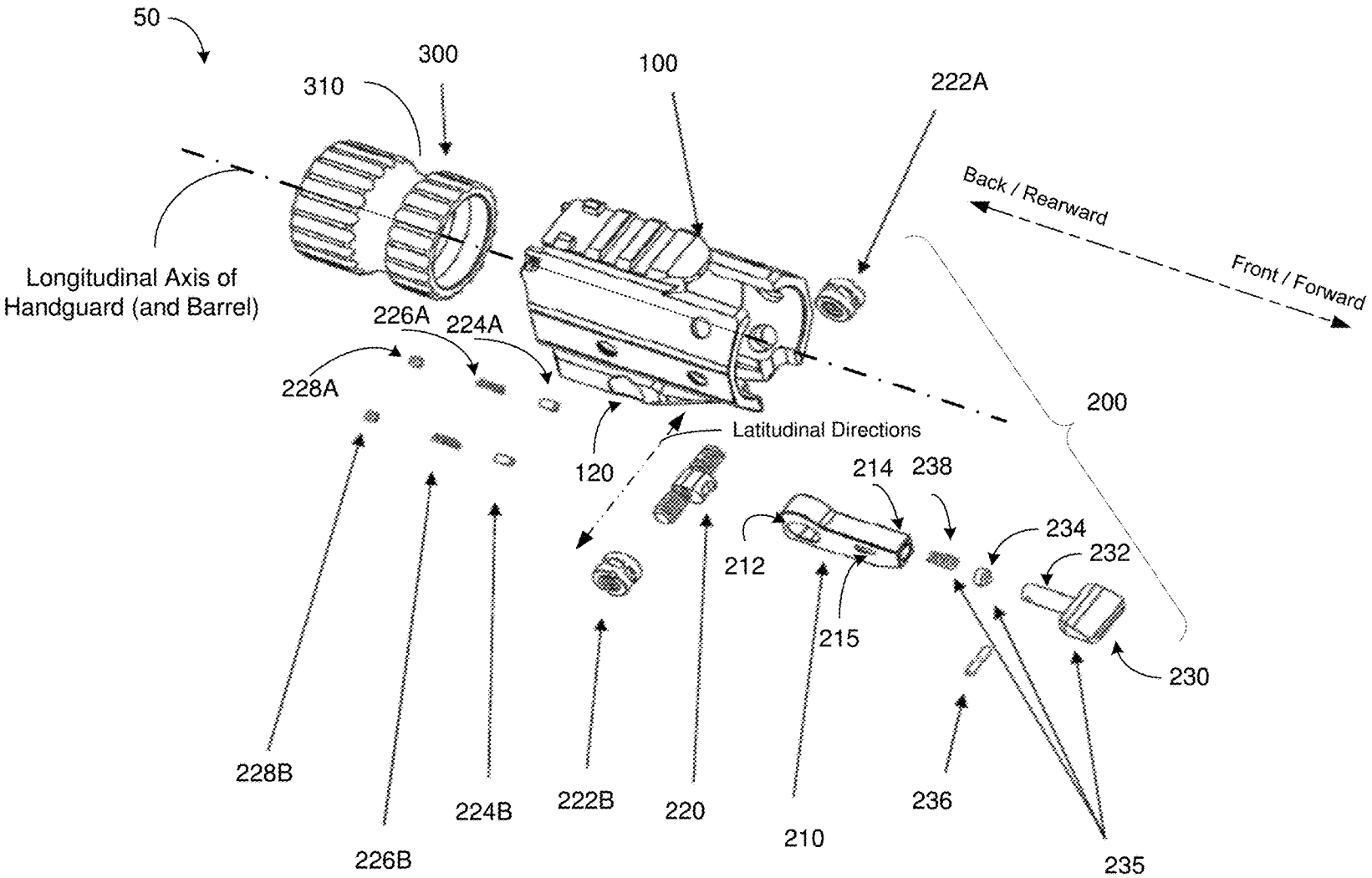
FIG. 1 is a diagram of an exploded view of an apparatus implementable on a firearm in accordance with an implementation of the present disclosure.
Figure 2:
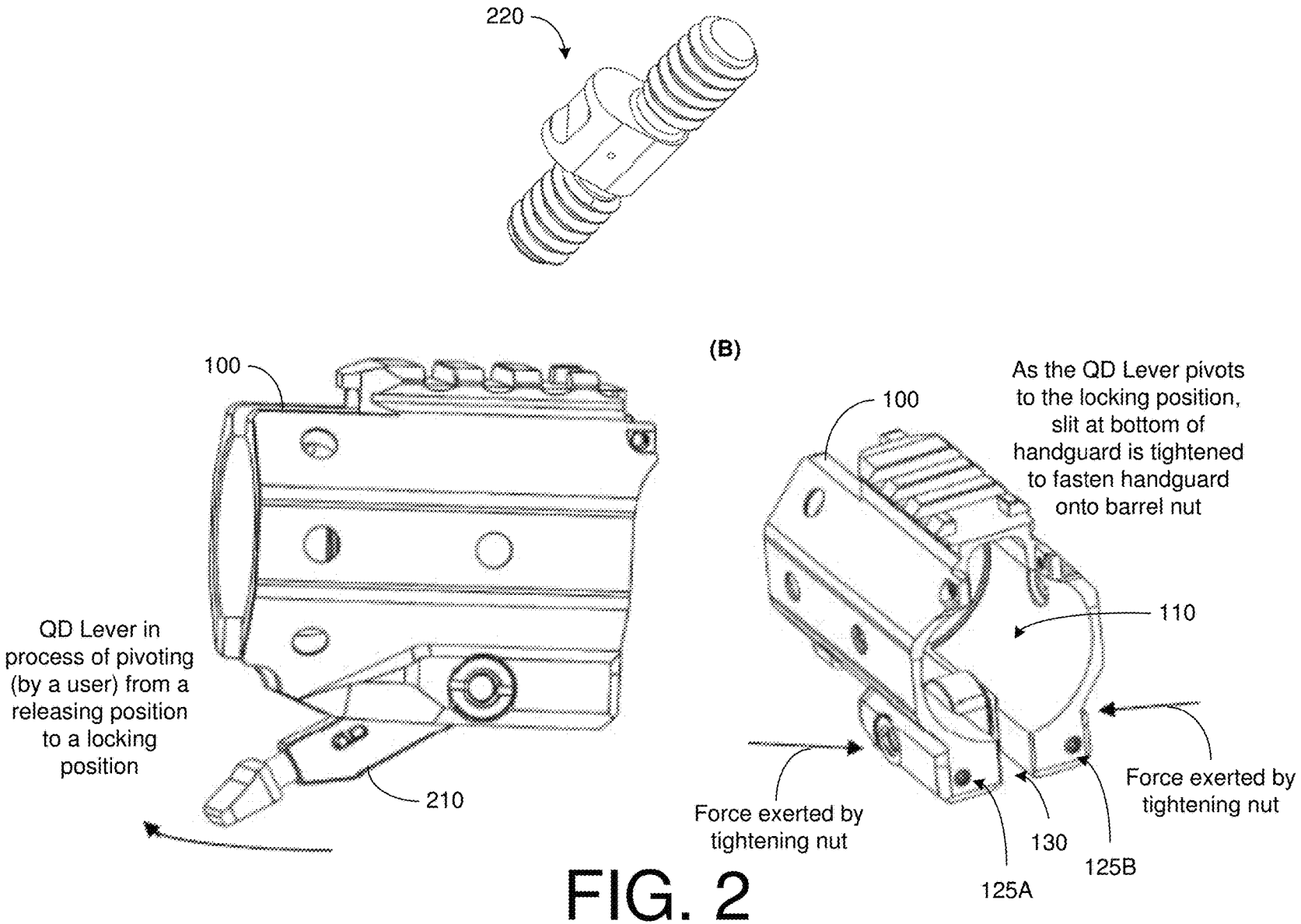
FIG. 2 is a diagram of various components of the apparatus of FIG. 1.
Figure 3:
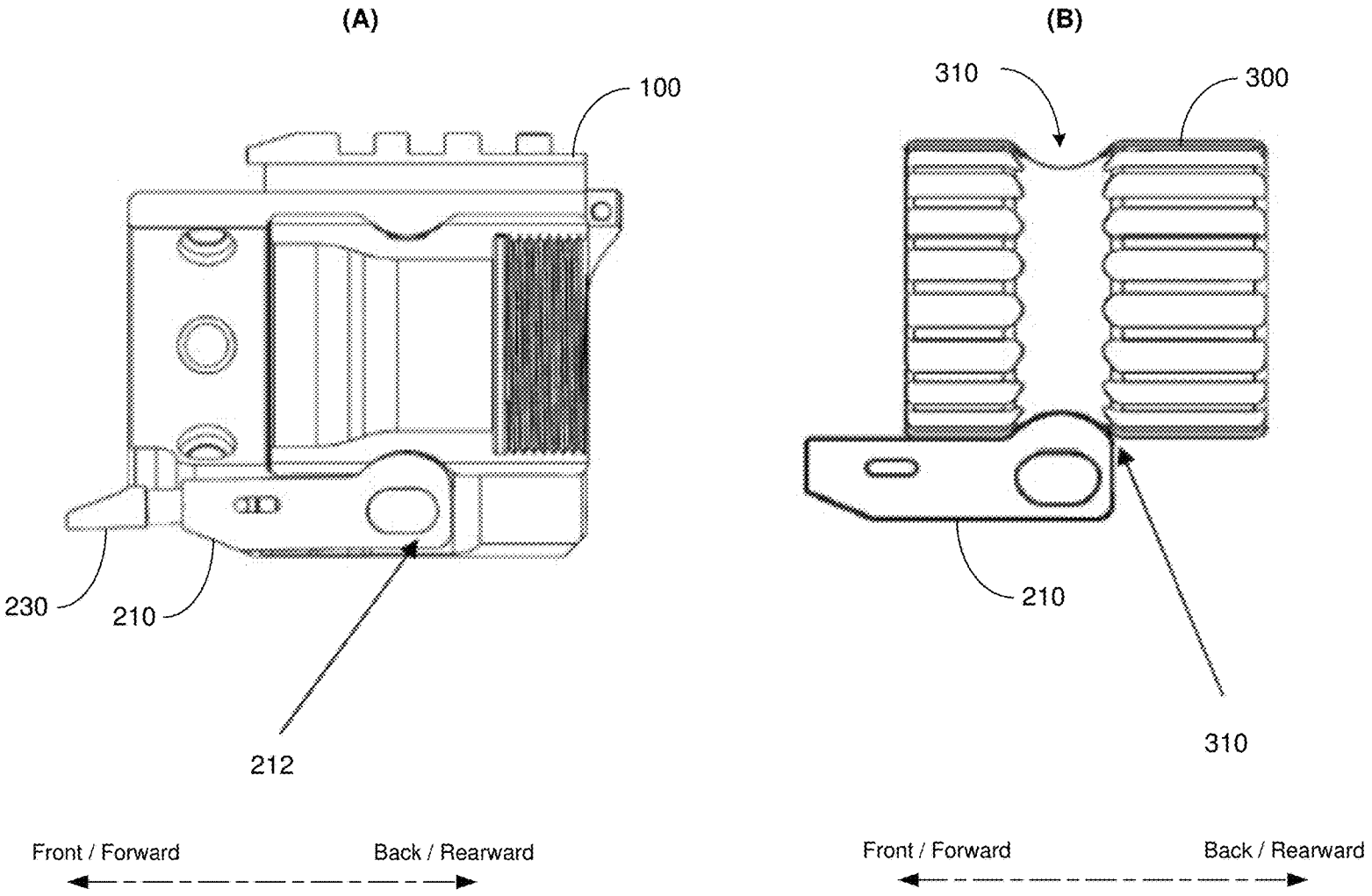
FIG. 3 is a diagram of various components of the apparatus of FIG. 1.
Figure 4:
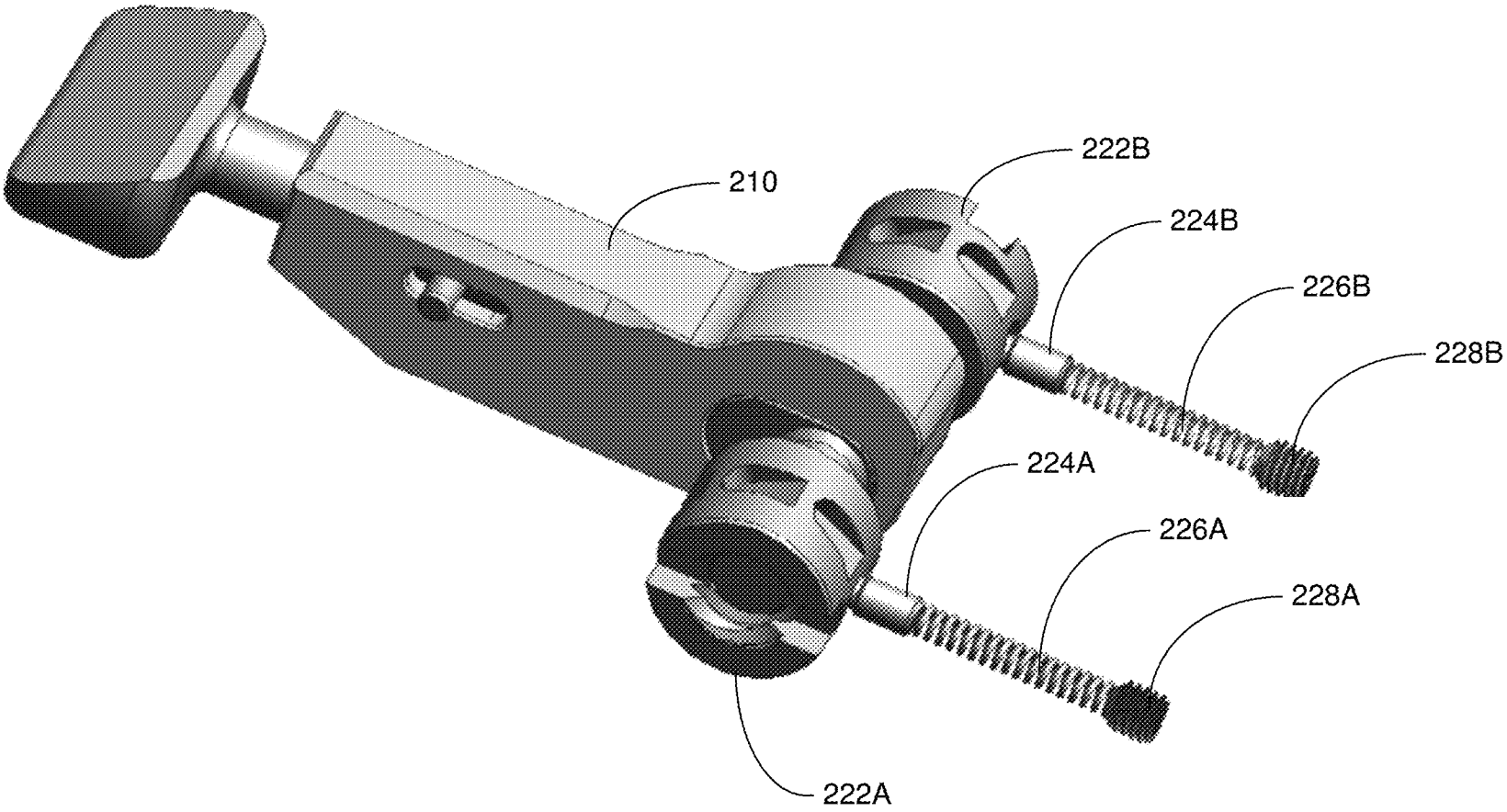
FIG. 4 is a diagram of various components of the apparatus of FIG. 1.
Figure 5:
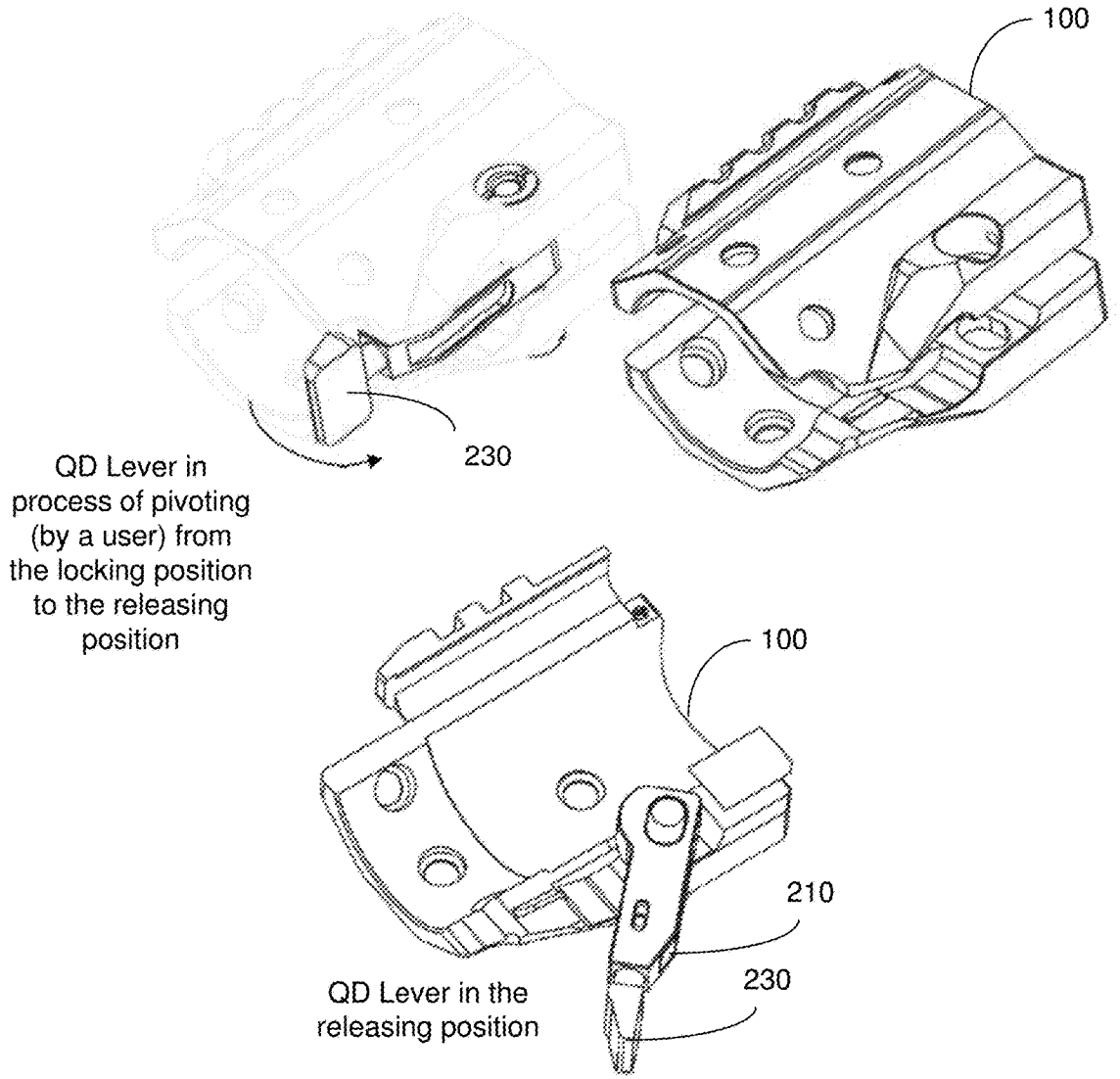
FIG. 5 is a diagram of various components of the apparatus of FIG. 1.
Figure 6:
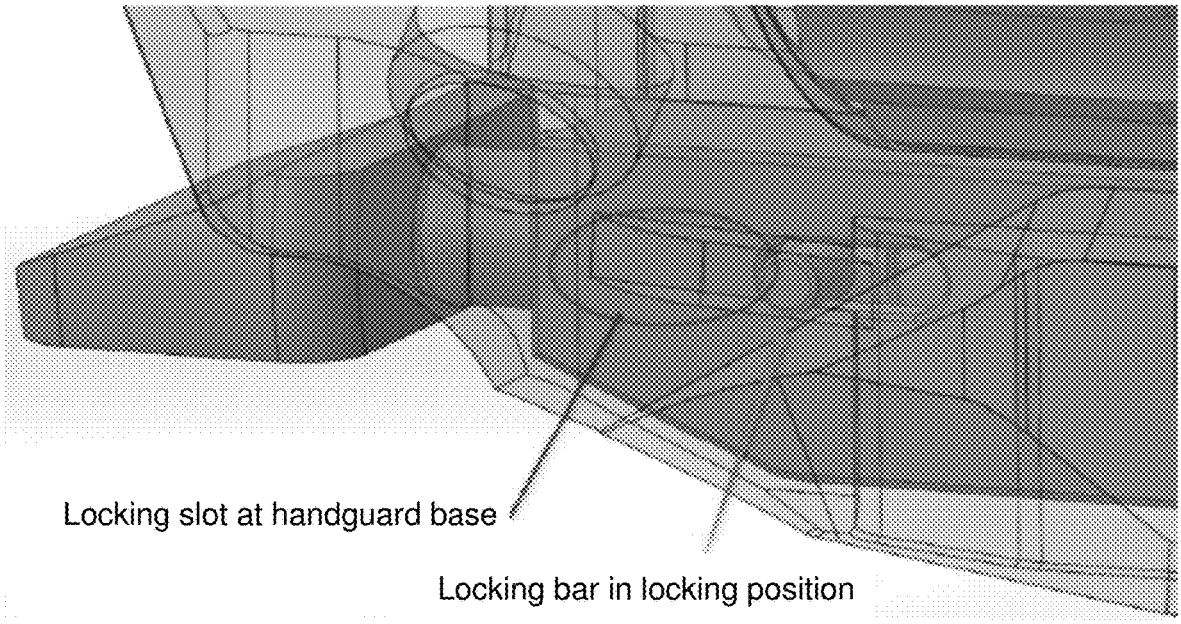
FIG. 6 is a diagram of various components of the apparatus of FIG. 1.
Figure 6:
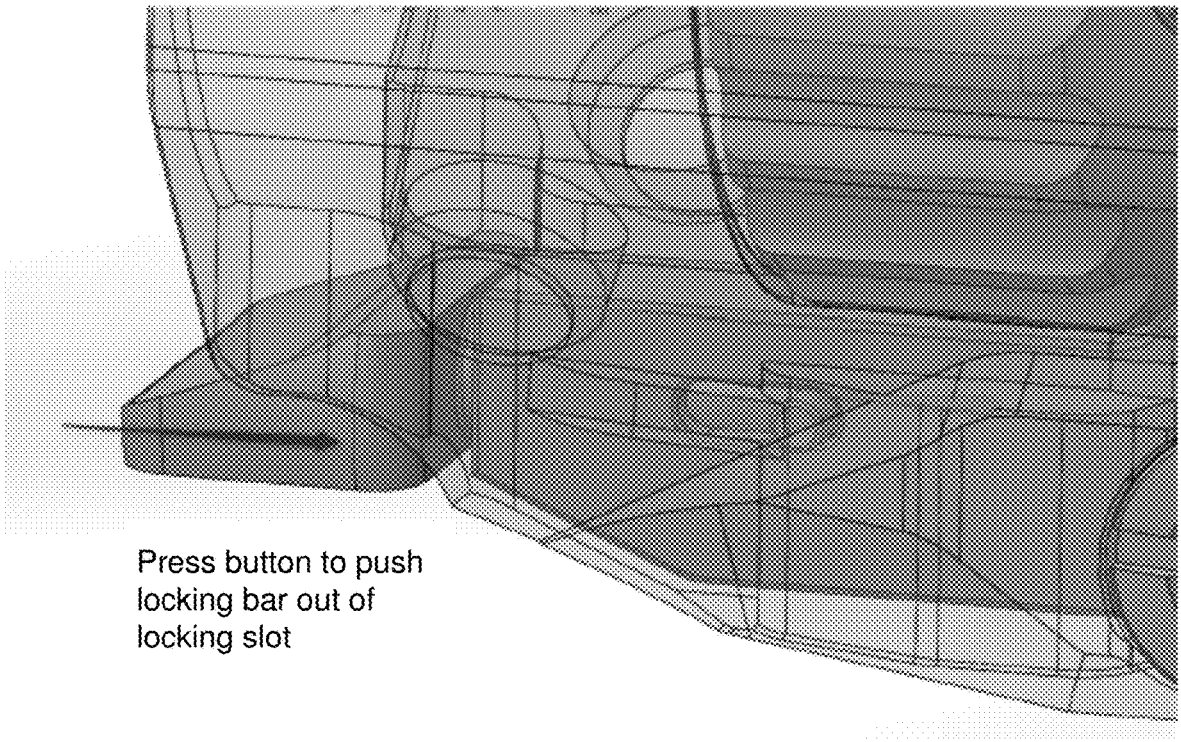

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

As used herein, the terms "proximal" and "proximally" may denote "forward" and "forwardly" with respect to the firearm, and the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. As used herein, the word "forward" means moving in the direction that the projectile moves during firing a firearm. As used herein, the word "proximal" means closer to the reference point, in this case, the shooter. As used herein, the word "distal" means farther to the reference point, in this case, the shooter. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g. 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

Overview

FIG. 1 illustrates an exploded view of an apparatus 50 implementable on a firearm (e.g., an AR-style firearm such as an AR-style rifle, carbine or pistol) in accordance with an implementation of the present disclosure. Each of FIG. 2~FIG. 5 illustrates various components of apparatus 50. Description of apparatus 50 and various components and operation thereof is provided below with respect to FIG. 1~FIG. 5.

Under a proposed design in accordance with the present disclosure, apparatus 50 may include a QD handguard assembly which may include a handguard 100 and a locking mechanism 200 coupled to the handguard 100. Apparatus 50 may also include a barrel nut 300. The handguard 100 may have a front end, a back end opposite the front end, and a hollow 110 therein allowing the handguard 100 to surround a barrel (not shown) of the firearm with the barrel traversing through the hollow 110 along a longitudinal axis of the handguard 100 (which coincides with a longitudinal axis of the barrel and firearm when the handguard 100 is installed on the firearm). The handguard 100 may be configured with a slit 130 extending along the longitudinal axis of the handguard 100 between the front end and the back end. The handguard 100 may be also configured with a first opening near the slit and on a first side (e.g., left side) thereof and a second opening (labeled by numeral reference 120 in FIG. 1) near the slit and on a second side (e.g., right side) thereof opposite the first side with the first opening and the second opening aligned with each other. The locking mechanism 200 may be configured to lock the handguard 100 to the barrel nut 300 of the firearm and unlock the handguard 100 from the barrel nut 300.

The locking mechanism 200 may include a first tightening nut 222A rotatably received in the first opening of the handguard 100, a second tightening nut 222B rotatably received in the second opening of the handguard 100, a fastener 220, and a QD lever 210. The fastener 220 may have a first distal end (e.g., left distal end) and a second distal end (e.g., right distal end) opposite the first distal end. As shown in part (A) of FIG. 2, the fastener 220 may be configured with left-hand threads near the first distal end and right-hand threads near the second distal end. The fastener 220 may traverse the handguard 100 latitudinally through the first opening and the second opening such that the first tightening nut 222A is threaded onto the first distal end of the fastener 220 and the second tightening nut 222B is threaded onto the second distal end of the fastener 220. The QD lever 210 may be coupled to a central section of the fastener 220 between the first distal end and the second distal end thereof. Thus, the QD lever 210 may be pivotably received in the slit 130 of the handguard 100 to pivot between a releasing position and a locking position such that: (1) when the QD lever 210 is at the releasing position, the QD handguard assembly may be freely movable along the barrel of the firearm, and (2) when the QD lever 210 is at the locking position with the back end of the handguard 100 surrounding the barrel nut 300, the first tightening nut 222A and the second tightening nut 222B are pulled toward the central section of the fastener 220 to elastically decrease a width of the slit 130 to result in the handguard 100 tightly wrapping and engaging the barrel nut 300, thereby preventing a movement of the handguard 100 along the barrel of the firearm. In the example shown in FIG. 1 and FIG. 3, a cross sectional profile or shape of the central section of the fastener 220 may be oval or another non-circular (non-round) shape. Correspondingly, the QD lever 210 may be configured with a coupling hole with a matching shape to mate or engage with the central section of the fastener 220 such that, when the central section of the fastener 220 is received in the coupling hole on the QD lever 210, a pivoting or swinging movement of the QD lever 210 would result in a corresponding rotation of the fastener 220.

In some implementations, the QD lever 210 may have a base end and an actuation end opposite the base end with the base end 212 coupled to the fastener 220. An outer contour of the base end 212 may be shaped such that, when the QD lever 210 is at the releasing position, the base end 212 is not engaged with the barrel nut 300 and, when the QD lever 210 is at the locking position, the base end 212 is received in an indentation 310 on the barrel nut 300 (e.g., a groove around a circumference of the barrel nut 300) to engage with the barrel nut 300. For instance, when the QD lever 210 is in the releasing position, a flat portion of the base end 212 is turned toward the indentation 310 on the barrel nut 300 and, as a result, the base end 212 of the QD lever 210 is not received in and does not engage with the indentation 310 of the barrel nut 300. Conversely, when the QD lever 210 is in the locking position (as shown in part (A) and part (B) of FIG. 3), a protruding portion of the base end 212 is turned toward the indentation 310 on the barrel nut 300 and, as a result, the base end 212 of the QD lever 210 is received in and engages with the indentation 310 of the barrel nut 300.

In some implementations, the locking mechanism 200 may also include a first detent system and a second detent system. The first detent system may include a first detent

224A, a first detent spring 226A, and a first set screw 228A. The second detent system may include a second detent 224B, a second detent spring 226B, and a second set screw 228B. In such cases, the handguard 100 may be further configured with a first detent opening 125A traversing a first portion of the handguard 100 through the first opening. Moreover, the handguard 100 may be further configured with a second detent opening 125B traversing a second portion of the handguard 100 through the second opening. Additionally, a circumference of the first tightening nut 222A may be configured with a plurality of first indentations, and a circumference of the second tightening nut 222B may be configured with a plurality of second indentations. Moreover, the first detent system may be disposed in the first detent opening 125A with the first detent 224A protruding into the first opening to physically contact with the circumference with the first tightening nut 222A such that, when the QD lever 210 is pivoted between the releasing position and the locking position, the first detent 224A is pushed by a first force exerted by the first set screw 228A through the first detent spring 226A to enter into and engage with each of the plurality of first indentations. Similarly, the second detent system may be disposed in the second detent opening 125B with the second detent 224B protruding into the second opening to physically contact with the circumference with the second tightening nut 222B such that, when the QD lever 210 is pivoted between the releasing position and the locking position, the second detent 224B is pushed by a second force exerted by the second set screw 228B through the second detent spring 226B to enter into and engage with each of the plurality of second indentations.

In some implementations, each of the plurality of first indentations and the plurality of second indentations may be shaped such that the QD lever 210 is pivotable from the releasing position to the locking position but not from the locking position to the releasing position unless the first set screw 228A and the second set screw 228B are loosened to remove the first force exerted on the first detent 224A by the first set screw 228A through the first detent spring 226A and the second force exerted on the second detent 224B by the second set screw 228B through the second detent spring 226B.

In some implementations, the handguard 100 may also have a physical feature configured to lock the QD lever 210 in the locking position. In some implementations, the physical feature may include a first slot on the first side (e.g., left side) and a second slot on the second side (e.g., right side) thereof. In such cases, the QD lever 210 may have a base end 212 and an actuation end 214 opposite the base end 212 with the base end 212 coupled to the fastener 220. Additionally, the QD lever 210 may also have a cavity at a tip of the actuation end 214 and a through hole 215 traversing a portion of the cavity. In such cases, the locking mechanism 200 may further include a spring-loaded QD lever locking button assembly 235 received in the cavity at the tip of the actuation end 214 of the QD lever 210. The QD lever locking button assembly 235 may include at least a QD lever locking button 230, a button pin 232 protruding from the QD lever locking button, a cushion 234, a spring 238, and a locking bar 236 traversing through the through hole 215 and the button pin 232. When the QD lever 210 is in the locking position without the QD lever locking button 230 being depressed, two opposite ends of the locking bar 236 may be received at a first end (e.g., front end) of each of the first slot and the second slot on the handguard 100 such that the QD lever 210 is prevented from being pivoted out of the locking position. When the QD lever 210 is in the locking position with the QD lever locking button 230 being depressed, the two opposite ends of the locking bar 236 may be received at a second end (e.g., back end) of each of the first slot and the second slot on the handguard 100 such that the QD lever 210 is pivotable from the locking position to the releasing position.

Highlight of Select Features

In view of the above, select features of various implementations in accordance with the present disclosure are highlighted below.

In one aspect, an apparatus implementable on a firearm may include a QD handguard assembly which may include a handguard and a locking mechanism coupled to the handguard. The handguard may have a front end, a back end opposite the front end, and a hollow therein allowing the handguard to surround a barrel of the firearm with the barrel traversing through the hollow along a longitudinal axis of the handguard. The handguard may be configured with a slit extending along the longitudinal axis of the handguard between the front end and the back end. The handguard may be also configured with a first opening near the slit and on a first side thereof and a second opening near the slit and on a second side thereof opposite the first side with the first opening and the second opening aligned with each other. The locking mechanism may be configured to lock the handguard to a barrel nut of the firearm and unlock the handguard from the barrel nut. The locking mechanism may include a first tightening nut rotatably received in the first opening of the handguard, a second tightening nut rotatably received in the second opening of the handguard, a fastener, and a QD lever. The fastener may have a first distal end and a second distal end opposite the first distal end. The fastener may be configured with left-hand threads near the first distal end and right-hand threads near the second distal end. The fastener may traverse the handguard latitudinally through the first opening and the second opening such that the first tightening nut is threaded onto the first distal end and the second tightening nut is threaded onto the second distal end. The QD lever may be coupled to a central section of the fastener between the first distal end and the second distal end thereof to be pivotably received in the slit of the handguard to pivot between a releasing position and a locking position such that: (1) when the QD lever is at the releasing position, the QD handguard assembly may be freely movable along the barrel of the firearm, and (2) when the QD lever is at the locking position with the back end of the handguard surrounding the barrel nut, the first tightening nut and the second tightening nut are pulled toward the central section of the fastener to elastically decrease a width of the slit to result in the handguard wrapping and engaging the barrel nut, thereby preventing a movement of the handguard along the barrel of the firearm.

In some implementations, the QD lever may have a base end and an actuation end opposite the base end with the base end coupled to the fastener. An outer contour of the base end may be shaped such that, when the QD lever is at the releasing position, the base end is not engaged with the barrel nut and, when the QD lever is at the locking position, the base end is received in an indentation on the barrel nut to engage with the barrel nut.

In some implementations, the locking mechanism may also include a first detent system and a second detent system. The first detent system may include a first detent, a first detent spring, and a first set screw, and the second detent system may include a second detent, a second detent spring, and a second set screw. In such cases, the handguard may be further configured with a first detent opening traversing a first portion of the handguard through the first opening and a second detent opening traversing a second portion of the handguard through the second opening. Additionally, a circumference of the first tightening nut may be configured with a plurality of first indentations, and a circumference of the second tightening nut may be configured with a plurality of second indentations. Moreover, the first detent system may be disposed in the first detent opening with the first detent protruding into the first opening to physically contact with the circumference with the first tightening nut such that, when the QD lever is pivoted between the releasing position and the locking position, the first detent is pushed by a first force exerted by the first set screw through the first detent spring to enter into and engage with each of the plurality of first indentations. Furthermore, the second detent system may be disposed in the second detent opening with the second detent protruding into the second opening to physically contact with the circumference with the second tightening nut such that, when the QD lever is pivoted between the releasing position and the locking position, the second detent is pushed by a second force exerted by the second set screw through the second detent spring to enter into and engage with each of the plurality of second indentations.

In some implementations, each of the plurality of first indentations and the plurality of second indentations may be shaped such that the QD lever is pivotable from the releasing position to the locking position but not from the locking position to the releasing position unless the first set screw and the second set screw are loosened to remove the first force exerted on the first detent by the first set screw through the first detent spring and the second force exerted on the second detent by the second set screw through the second detent spring.

In some implementations, the handguard may also have a physical feature configured to lock the QD lever in the locking position. In some implementations, the physical feature may include a first slot on the first side and a second slot on the second side thereof. In such cases, the QD lever may have a base end and an actuation end opposite the base end with the base end coupled to the fastener. Additionally, the QD lever may also have a cavity at a tip of the actuation end and a through hole traversing a portion of the cavity. In such cases, the locking mechanism may further include a spring-loaded QD lever locking button assembly received in the cavity at the tip of the actuation end of the QD lever. The QD lever locking button assembly may include at least a QD lever locking button, a button pin protruding from the QD lever locking button, a spring, and a locking bar traversing through the through hole and the button pin. When the QD lever is in the locking position without the QD lever locking button being depressed, two opposite ends of the locking bar may be received at a first end of each of the first slot and the second slot on the handguard such that the QD lever is prevented from being pivoted out of the locking position. When the QD lever is in the locking position with the QD lever locking button being depressed, the two opposite ends of the locking bar may be received at a second end of each of the first slot and the second slot on the handguard such that the QD lever is pivotable from the locking position to the releasing position.

In some implementations, the apparatus may further include the barrel nut with an outer surface of the barrel nut configured with an indentation. In such cases, the QD lever may have a base end and an actuation end opposite the base end with the base end coupled to the fastener. An outer contour of the base end may be shaped such that: (1) when the QD lever is at the releasing position, the base end is not engaged with the barrel nut, and (2) when the QD lever is at the locking position, the base end is received in the indentation on the barrel nut to engage with the barrel nut.

In another aspect, an apparatus implementable on a firearm may include a QD handguard assembly which may include a handguard and a locking mechanism coupled to the handguard. The handguard may have a hollow therein allowing the handguard to surround a barrel of the firearm with the barrel traversing through the hollow along a longitudinal axis of the handguard. The locking mechanism may include a QD lever configured to lock the handguard to a barrel nut of the firearm and unlock the handguard from the barrel nut.

In some implementations, the handguard may have a front end, a back end opposite the front end, and the handguard may be configured with a slit extending along the longitudinal axis of the handguard between the front end and the back end. The handguard may be also configured with a first opening near the slit and on a first side thereof and a second opening near the slit and on a second side thereof opposite the first side with the first opening and the second opening aligned with each other. In such cases, the QD lever may be pivotably received in the slit of the handguard to pivot between a releasing position and a locking position.

In some implementations, the locking mechanism may also include a first tightening nut rotatably received in the first opening of the handguard, a second tightening nut rotatably received in the second opening of the handguard, and a fastener. The fastener may have a first distal end and a second distal end opposite the first distal end. The fastener may be configured with left-hand threads near the first distal end and right-hand threads near the second distal end. The fastener may traverse the handguard latitudinally through the first opening and the second opening such that the first tightening nut is threaded onto the first distal end and the second tightening nut is threaded onto the second distal end. The QD lever may be coupled to a central section of the fastener between the first distal end and the second distal end thereof to be pivotably received in the slit of the handguard to pivot between the releasing position and the locking position such that: (1) when the QD lever is at the releasing position, the QD handguard assembly may be freely movable along the barrel of the firearm, and (2) when the QD lever is at the locking position with the back end of the handguard surrounding the barrel nut, the first tightening nut and the second tightening nut are pulled toward the central section of the fastener to elastically decrease a width of the slit to result in the handguard wrapping and engaging the barrel nut, thereby preventing a movement of the handguard along the barrel of the firearm.

In some implementations, the QD lever may have a base end and an actuation end opposite the base end with the base end coupled to the fastener. In such cases, an outer contour of the base end may be shaped such that, when the QD lever is at the releasing position, the base end is not engaged with the barrel nut and, when the QD lever is at the locking position, the base end is received in an indentation on the barrel nut to engage with the barrel nut.

In some implementations, the locking mechanism may further include a first detent system and a second detent system. The first detent system may include a first detent, a first detent spring, and a first set screw, and the second detent system may include a second detent, a second detent spring, and a second set screw. In such cases, the handguard may be further configured with a first detent opening traversing a first portion of the handguard through the first opening and a second detent opening traversing a second portion of the handguard through the second opening. A circumference of the first tightening nut may be configured with a plurality of first indentations, and a circumference of the second tightening nut may be configured with a plurality of second indentations. Additionally, the first detent system may be disposed in the first detent opening with the first detent protruding into the first opening to physically contact with the circumference with the first tightening nut such that, when the QD lever is pivoted between the releasing position and the locking position, the first detent is pushed by a first force exerted by the first set screw through the first detent spring to enter into and engage with each of the plurality of first indentations. Moreover, the second detent system may be disposed in the second detent opening with the second detent protruding into the second opening to physically contact with the circumference with the second tightening nut such that, when the QD lever is pivoted between the releasing position and the locking position, the second detent is pushed by a second force exerted by the second set screw through the second detent spring to enter into and engage with each of the plurality of second indentations.

In some implementations, each of the plurality of first indentations and the plurality of second indentations may be shaped such that the QD lever is pivotable from the releasing position to the locking position but not from the locking position to the releasing position unless the first set screw and the second set screw are loosened to remove the first force exerted on the first detent by the first set screw through the first detent spring and the second force exerted on the second detent by the second set screw through the second detent spring.

In some implementations, the handguard may have a physical feature configured to lock the QD lever in the locking position. In some implementations, the physical feature may include a first slot on the first side and a second slot on the second side thereof. Additionally, the QD lever may have a base end and an actuation end opposite the base end with the base end coupled to the fastener. Moreover, the QD lever may also have a cavity at a tip of the actuation end and a through hole traversing a portion of the cavity. In such cases, the locking mechanism may further include a spring-loaded QD lever locking button assembly received in the cavity at the tip of the actuation end of the QD lever, and the QD lever locking button assembly may include at least a QD lever locking button, a button pin protruding from the QD lever locking button, a spring, and a locking bar traversing through the through hole and the button pin. When the QD lever is in the locking position without the QD lever locking button being depressed, two opposite ends of the locking bar may be received at a first end of each of the first slot and the second slot on the handguard such that the QD lever is prevented from being pivoted out of the locking position. When the QD lever is in the locking position with the QD lever locking button being depressed, the two opposite ends of the locking bar may be received at a second end of each of the first slot and the second slot on the handguard such that the QD lever is pivotable from the locking position to the releasing position.

In some implementations, the apparatus may further include the barrel nut with an outer surface of the barrel nut configured with an indentation. The QD lever may have a base end and an actuation end opposite the base end with the base end coupled to the fastener. In such cases, an outer contour of the base end may be shaped such that: (1) when the QD lever is at the releasing position, the base end is not engaged with the barrel nut, and (2) when the QD lever is at the locking position, the base end is received in the indentation on the barrel nut to engage with the barrel nut.

In still another aspect, an apparatus implementable on a firearm may include a QD handguard assembly which may include a handguard and a locking mechanism coupled to the handguard. The handguard may have a front end, a back end opposite the front end, and a hollow therein allowing the handguard to surround a barrel of the firearm with the barrel traversing through the hollow along a longitudinal axis of the handguard. The handguard may be configured with a slit extending along the longitudinal axis of the handguard between the front end and the back end. The locking mechanism may include a QD lever configured to lock the handguard to a barrel nut of the firearm and unlock the handguard from the barrel nut. The QD lever may be pivotably received in the slit of the handguard to pivot between a releasing position and a locking position. The handguard may have a physical feature configured to lock the QD lever in the locking position.

In some implementations, the handguard may be also configured with a first opening near the slit and on a first side thereof and a second opening near the slit and on a second side thereof opposite the first side with the first opening and the second opening aligned with each other. In such cases, the locking mechanism may also include a first tightening nut rotatably received in the first opening of the handguard, a second tightening nut rotatably received in the second opening of the handguard, and a fastener. The fastener may have a first distal end and a second distal end opposite the first distal end, and the fastener may be configured with left-hand threads near the first distal end and right-hand threads near the second distal end. The fastener may traverse the handguard latitudinally through the first opening and the second opening such that the first tightening nut is threaded onto the first distal end and the second tightening nut is threaded onto the second distal end. Additionally, the QD lever may be coupled to a central section of the fastener between the first distal end and the second distal end thereof to be pivotably received in the slit of the handguard to pivot between the releasing position and the locking position. When the QD lever is at the releasing position, the QD handguard assembly may be freely movable along the barrel of the firearm. When the QD lever is at the locking position with the back end of the handguard surrounding the barrel nut, the first tightening nut and the second tightening nut may be pulled toward the central section of the fastener to elastically decrease a width of the slit to result in the handguard wrapping and engaging the barrel nut, thereby preventing a movement of the handguard along the barrel of the firearm. Moreover, the QD lever may have a base end and an actuation end opposite the base end with the base end coupled to the fastener. Furthermore, an outer contour of the base end may be shaped such that, when the QD lever is at the releasing position, the base end is not engaged with the barrel nut and, when the QD lever is at the locking position, the base end is received in an indentation on the barrel nut to engage with the barrel nut.

In some implementations, the locking mechanism may further include a first detent system and a second detent system. The first detent system may include a first detent, a first detent spring, and a first set screw, and the second detent system may include a second detent, a second detent spring, and a second set screw. In such cases, the handguard may be further configured with a first detent opening traversing a first portion of the handguard through the first opening and a second detent opening traversing a second portion of the handguard through the second opening. A circumference of the first tightening nut may be configured with a plurality of first indentations, and a circumference of the second tightening nut may be configured with a plurality of second indentations. The first detent system may be disposed in the first detent opening with the first detent protruding into the first opening to physically contact with the circumference with the first tightening nut such that, when the QD lever is pivoted between the releasing position and the locking position, the first detent is pushed by a first force exerted by the first set screw through the first detent spring to enter into and engage with each of the plurality of first indentations. The second detent system may be disposed in the second detent opening with the second detent protruding into the second opening to physically contact with the circumference with the second tightening nut such that, when the QD lever is pivoted between the releasing position and the locking position, the second detent is pushed by a second force exerted by the second set screw through the second detent spring to enter into and engage with each of the plurality of second indentations. Moreover, each of the plurality of first indentations and the plurality of second indentations may be shaped such that the QD lever is pivotable from the releasing position to the locking position but not from the locking position to the releasing position unless the first set screw and the second set screw are loosened to remove the first force exerted on the first detent by the first set screw through the first detent spring and the second force exerted on the second detent by the second set screw through the second detent spring.

In some implementations, the handguard may have a physical feature configured to lock the QD lever in the locking position. In some implementations, the physical feature may include a first slot on the first side and a second slot on the second side thereof. In such cases, the QD lever may have a base end and an actuation end opposite the base end with the base end coupled to the fastener. The QD lever may also have a cavity at a tip of the actuation end and a through hole traversing a portion of the cavity. The locking mechanism may further include a spring-loaded QD lever locking button assembly received in the cavity at the tip of the actuation end of the QD lever. Additionally, the QD lever locking button assembly may include at least a QD lever locking button, a button pin protruding from the QD lever locking button, a spring, and a locking bar traversing through the through hole and the button pin. When the QD lever is in the locking position without the QD lever locking button being depressed, two opposite ends of the locking bar may be received at a first end of each of the first slot and the second slot on the handguard such that the QD lever is prevented from being pivoted out of the locking position. When the QD lever is in the locking position with the QD lever locking button being depressed, the two opposite ends of the locking bar may be received at a second end of each of the first slot and the second slot on the handguard such that the QD lever is pivotable from the locking position to the releasing position.

In some implementations, the apparatus may further include the barrel nut with an outer surface of the barrel nut configured with an indentation. In such cases, the QD lever may have a base end and an actuation end opposite the base end with the base end coupled to the fastener. An outer contour of the base end may be shaped such that: (1) when the QD lever is at the releasing position, the base end is not engaged with the barrel nut, and (2) when the QD lever is at the locking position, the base end is received in the indentation on the barrel nut to engage with the barrel nut.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. An apparatus implementable on a firearm, comprising:

a quick-detach (QD) handguard assembly comprising:

a handguard having a front end, a back end opposite the front end, and a hollow therein allowing the handguard to surround a barrel of the firearm with the barrel traversing through the hollow along a longitudinal axis of the handguard, the handguard configured with a slit extending along the longitudinal axis of the handguard between the front end and the back end, the handguard also configured with a first opening near the slit and on a first side thereof and a second opening near the slit and on a second side thereof opposite the first side with the first opening and the second opening aligned with each other; and a locking mechanism coupled to the handguard and configured to lock the handguard to a barrel nut of the firearm and unlock the handguard from the barrel nut, the locking mechanism comprising:

a first tightening nut rotatably received in the first opening of the handguard;

a second tightening nut rotatably received in the second opening of the handguard;

a fastener having a first distal end and a second distal end opposite the first distal end, the fastener configured with left-hand threads near the first distal end and right-hand threads near the second distal end, the fastener traversing the handguard latitudinally through the first opening and the second opening such that the first tightening nut is threaded onto the first distal end and the second tightening nut is threaded onto the second distal end; and a quick-detach (QD) lever coupled to a central section of the fastener between the first distal end and the second distal end thereof to be pivotably received in the slit of the handguard to pivot between a releasing position and a locking position such that:

when the QD lever is at the releasing position, the QD handguard assembly is freely movable along the barrel of the firearm, and when the QD lever is at the locking position with the back end of the handguard surrounding the barrel nut, the first tightening nut and the second tightening nut are pulled toward the central section of the fastener to elastically decrease a width of the slit to result in the handguard wrapping and engaging the barrel nut, thereby preventing a movement of the handguard along the barrel of the firearm, wherein the QD lever has a base end and an actuation end opposite the base end with the base end coupled to the fastener, and wherein an outer contour of the base end is shaped such that:

when the QD lever is at the releasing position, the base end is not engaged with the barrel nut and, when the QD lever is at the locking position, the base end is received in an indentation on the barrel nut to engage with the barrel nut.

2. The apparatus of claim 1, wherein the locking mechanism further comprises:

a first detent system comprising a first detent, a first detent spring, and a first set screw; and a second detent system comprising a second detent, a second detent spring, and a second set screw, wherein the handguard is further configured with:

a first detent opening traversing a first portion of the handguard through the first opening, and a second detent opening traversing a second portion of the handguard through the second opening, wherein a circumference of the first tightening nut is configured with a plurality of first indentations, wherein a circumference of the second tightening nut is configured with a plurality of second indentations, wherein the first detent system is disposed in the first detent opening with the first detent protruding into the first opening to physically contact with the circumference with the first tightening nut such that, when the QD lever is pivoted between the releasing position and the locking position, the first detent is pushed by a first force exerted by the first set screw through the first detent spring to enter into and engage with each of the plurality of first indentations, and wherein the second detent system is disposed in the second detent opening with the second detent protruding into the second opening to physically contact with the circumference with the second tightening nut such that, when the QD lever is pivoted between the releasing position and the locking position, the second detent is pushed by a second force exerted by the second set screw through the second detent spring to enter into and engage with each of the plurality of second indentations.

3. The apparatus of claim 2, wherein each of the plurality of first indentations and the plurality of second indentations is shaped such that the QD lever is pivotable from the releasing position to the locking position but not from the locking position to the releasing position unless the first set screw and the second set screw are loosened to remove the first force exerted on the first detent by the first set screw through the first detent spring and the second force exerted on the second detent by the second set screw through the second detent spring.

4. The apparatus of claim 1, wherein the handguard further has a physical feature configured to lock the QD lever in the locking position.

5. The apparatus of claim 4, wherein the physical feature comprises a first slot on the first side and a second slot on the second side thereof, wherein the QD lever has a base end and an actuation end opposite the base end with the base end coupled to the fastener, wherein the QD lever further has a cavity at a tip of the actuation end and a through hole traversing a portion of the cavity, and wherein the locking mechanism further comprises:

a spring-loaded QD lever locking button assembly received in the cavity at the tip of the actuation end of the QD lever, the QD lever locking button assembly comprising at least a QD lever locking button, a button pin protruding from the QD lever locking button, a spring, and a locking bar traversing through the through hole and the button pin, wherein, when the QD lever is in the locking position without the QD lever locking button being depressed, two opposite ends of the locking bar are received at a first end of each of the first slot and the second slot on the handguard such that the QD lever is prevented from being pivoted out of the locking position, and wherein, when the QD lever is in the locking position with the QD lever locking button being depressed, the two opposite ends of the locking bar are received at a second end of each of the first slot and the second slot on the handguard such that the QD lever is pivotable from the locking position to the releasing position.

6. The apparatus of claim 1, further comprising:

the barrel nut, wherein an outer surface of the barrel nut is configured with an indentation, wherein the QD lever has a base end and an actuation end opposite the base end with the base end coupled to the fastener, and wherein an outer contour of the base end is shaped such that:

when the QD lever is at the releasing position, the base end is not engaged with the barrel nut, and when the QD lever is at the locking position, the base end is received in the indentation on the barrel nut to engage with the barrel nut.

7. An apparatus implementable on a firearm, comprising:

a quick-detach (QD) handguard assembly comprising:

a handguard having a hollow therein allowing the handguard to surround a barrel of the firearm with the barrel traversing through the hollow along a longitudinal axis of the handguard; and a locking mechanism coupled to the handguard, the locking mechanism comprising a QD lever configured to lock the handguard to a barrel nut of the firearm and unlock the handguard from the barrel nut wherein the QD lever has a base end and an actuation end opposite the base end, and wherein an outer contour of the base end is shaped such that:

when the QD lever is at the releasing position, the base end is not engaged with the barrel nut and, when the QD lever is at the locking position, the base end is received in an indentation on the barrel nut to engage with the barrel nut.

8. The apparatus of claim 7, wherein the handguard has a front end, a back end opposite the front end, wherein the handguard is configured with a slit extending along the longitudinal axis of the handguard between the front end and the back end, the handguard also configured with a first opening near the slit and on a first side thereof and a second opening near the slit and on a second side thereof opposite the first side with the first opening and the second opening aligned with each other, and wherein the QD lever is pivotably received in the slit of the handguard to pivot between a releasing position and a locking position.

9. The apparatus of claim 7, wherein the locking mechanism further comprises:

a first tightening nut rotatably received in the first opening of the handguard;

a second tightening nut rotatably received in the second opening of the handguard; and a fastener having a first distal end and a second distal end opposite the first distal end, the fastener configured with left-hand threads near the first distal end and right-hand threads near the second distal end, the fastener traversing the handguard latitudinally through the first opening and the second opening such that the first tightening nut is threaded onto the first distal end and the second tightening nut is threaded onto the second distal end, wherein the QD lever is coupled to a central section of the fastener between the first distal end and the second distal end thereof to be pivotably received in the slit of the handguard to pivot between the releasing position and the locking position such that:

when the QD lever is at the releasing position, the QD handguard assembly is freely movable along the barrel of the firearm, and when the QD lever is at the locking position with the back end of the handguard surrounding the barrel nut, the first tightening nut and the second tightening nut are pulled toward the central section of the fastener to elastically decrease a width of the slit to result in the handguard wrapping and engaging the barrel nut, thereby preventing a movement of the handguard along the barrel of the firearm.

10. The apparatus of claim 9, wherein the locking mechanism further comprises:

a first detent system comprising a first detent, a first detent spring, and a first set screw; and a second detent system comprising a second detent, a second detent spring, and a second set screw, wherein the handguard is further configured with:

a first detent opening traversing a first portion of the handguard through the first opening, and a second detent opening traversing a second portion of the handguard through the second opening, wherein a circumference of the first tightening nut is configured with a plurality of first indentations, wherein a circumference of the second tightening nut is configured with a plurality of second indentations, wherein the first detent system is disposed in the first detent opening with the first detent protruding into the first opening to physically contact with the circumference with the first tightening nut such that, when the QD lever is pivoted between the releasing position and the locking position, the first detent is pushed by a first force exerted by the first set screw through the first detent spring to enter into and engage with each of the plurality of first indentations, and wherein the second detent system is disposed in the second detent opening with the second detent protruding into the second opening to physically contact with the circumference with the second tightening nut such that, when the QD lever is pivoted between the releasing position and the locking position, the second detent is pushed by a second force exerted by the second set screw through the second detent spring to enter into and engage with each of the plurality of second indentations.

11. The apparatus of claim 10, wherein each of the plurality of first indentations and the plurality of second indentations is shaped such that the QD lever is pivotable from the releasing position to the locking position but not from the locking position to the releasing position unless the first set screw and the second set screw are loosened to remove the first force exerted on the first detent by the first set screw through the first detent spring and the second force exerted on the second detent by the second set screw through the second detent spring.

12. The apparatus of claim 9, further comprising:

the barrel nut, wherein an outer surface of the barrel nut is configured with an indentation, wherein the QD lever has a base end and an actuation end opposite the base end with the base end coupled to the fastener, and wherein an outer contour of the base end is shaped such that:

when the QD lever is at the releasing position, the base end is not engaged with the barrel nut, and when the QD lever is at the locking position, the base end is received in the indentation on the barrel nut to engage with the barrel nut.

13. The apparatus of claim 7, wherein the handguard further has a physical feature configured to lock the QD lever in the locking position, wherein the physical feature comprises a first slot on the first side and a second slot on the second side thereof, wherein the QD lever has a base end and an actuation end opposite the base end with the base end coupled to the fastener, wherein the QD lever further has a cavity at a tip of the actuation end and a through hole traversing a portion of the cavity, and wherein the locking mechanism further comprises:

a spring-loaded QD lever locking button assembly received in the cavity at the tip of the actuation end of the QD lever, the QD lever locking button assembly comprising at least a QD lever locking button, a button pin protruding from the QD lever locking button, a spring, and a locking bar traversing through the through hole and the button pin, wherein, when the QD lever is in the locking position without the QD lever locking button being depressed, two opposite ends of the locking bar are received at a first end of each of the first slot and the second slot on the handguard such that the QD lever is prevented from being pivoted out of the locking position, and wherein, when the QD lever is in the locking position with the QD lever locking button being depressed, the two opposite ends of the locking bar are received at a second end of each of the first slot and the second slot on the handguard such that the QD lever is pivotable from the locking position to the releasing position.

14. An apparatus implementable on a firearm, comprising:

a quick-detach (QD) handguard assembly comprising:

a handguard having a front end, a back end opposite the front end, and a hollow therein allowing the handguard to surround a barrel of the firearm with the barrel traversing through the hollow along a longitudinal axis of the handguard, the handguard configured with a slit extending along the longitudinal axis of the handguard between the front end and the back end;

a locking mechanism coupled to the handguard, the locking mechanism comprising a QD lever configured to lock the handguard to a barrel nut of the firearm and unlock the handguard from the barrel nut; and a barrel nut, wherein the QD lever is pivotably received in the slit of the handguard to pivot between a releasing position and a locking position, wherein the handguard further has a physical feature configured to lock the QD lever in the locking position.

15. The apparatus of claim 14, wherein the handguard is also configured with a first opening near the slit and on a first side thereof and a second opening near the slit and on a second side thereof opposite the first side with the first opening and the second opening aligned with each other, and wherein the locking mechanism further comprises:

a first tightening nut rotatably received in the first opening of the handguard;

a second tightening nut rotatably received in the second opening of the handguard; and a fastener having a first distal end and a second distal end opposite the first distal end, the fastener configured with left-hand threads near the first distal end and right-hand threads near the second distal end, the fastener traversing the handguard latitudinally through the first opening and the second opening such that the first tightening nut is threaded onto the first distal end and the second tightening nut is threaded onto the second distal end, wherein the QD lever is coupled to a central section of the fastener between the first distal end and the second distal end thereof to be pivotably received in the slit of the handguard to pivot between the releasing position and the locking position, wherein, when the QD lever is at the releasing position, the QD handguard assembly is freely movable along the barrel of the firearm, wherein, when the QD lever is at the locking position with the back end of the handguard surrounding the barrel nut, the first tightening nut and the second tightening nut are pulled toward the central section of the fastener to elastically decrease a width of the slit to result in the handguard wrapping and engaging the barrel nut, thereby preventing a movement of the handguard along the barrel of the firearm, wherein the QD lever has a base end and an actuation end opposite the base end with the base end coupled to the fastener, and wherein an outer contour of the base end is shaped such that, when the QD lever is at the releasing position, the base end is not engaged with the barrel nut and, when the QD lever is at the locking position, the base end is received in an indentation on the barrel nut to engage with the barrel nut.

16. The apparatus of claim 15, wherein the locking mechanism further comprises:

a first detent system comprising a first detent, a first detent spring, and a first set screw; and a second detent system comprising a second detent, a second detent spring, and a second set screw, wherein the handguard is further configured with:

a first detent opening traversing a first portion of the handguard through the first opening, and a second detent opening traversing a second portion of the handguard through the second opening, wherein a circumference of the first tightening nut is configured with a plurality of first indentations, wherein a circumference of the second tightening nut is configured with a plurality of second indentations, wherein the first detent system is disposed in the first detent opening with the first detent protruding into the first opening to physically contact with the circumference with the first tightening nut such that, when the QD lever is pivoted between the releasing position and the locking position, the first detent is pushed by a first force exerted by the first set screw through the first detent spring to enter into and engage with each of the plurality of first indentations, wherein the second detent system is disposed in the second detent opening with the second detent protruding into the second opening to physically contact with the circumference with the second tightening nut such that, when the QD lever is pivoted between the releasing position and the locking position, the second detent is pushed by a second force exerted by the second set screw through the second detent spring to enter into and engage with each of the plurality of second indentations, and wherein each of the plurality of first indentations and the plurality of second indentations is shaped such that the QD lever is pivotable from the releasing position to the locking position but not from the locking position to the releasing position unless the first set screw and the second set screw are loosened to remove the first force exerted on the first detent by the first set screw through the first detent spring and the second force exerted on the second detent by the second set screw through the second detent spring.

17. The apparatus of claim 14, wherein the handguard further has a physical feature configured to lock the QD lever in the locking position, wherein the physical feature comprises a first slot on the first side and a second slot on the second side thereof, wherein the QD lever has a base end and an actuation end opposite the base end with the base end coupled to the fastener, wherein the QD lever further has a cavity at a tip of the actuation end and a through hole traversing a portion of the cavity, and wherein the locking mechanism further comprises:

a spring-loaded QD lever locking button assembly received in the cavity at the tip of the actuation end of the QD lever, the QD lever locking button assembly comprising at least a QD lever locking button, a button pin protruding from the QD lever locking button, a spring, and a locking bar traversing through the through hole and the button pin, wherein, when the QD lever is in the locking position without the QD lever locking button being depressed, two opposite ends of the locking bar are received at a first end of each of the first slot and the second slot on the handguard such that the QD lever is prevented from being pivoted out of the locking position, and wherein, when the QD lever is in the locking position with the QD lever locking button being depressed, the two opposite ends of the locking bar are received at a second end of each of the first slot and the second slot on the handguard such that the QD lever is pivotable from the locking position to the releasing position.

* * * * *